US005871687A

United States Patent [19]

LaBate, II

[11] Patent Number: 5,871,687

[45] Date of Patent: Feb. 16, 1999

[54] CONSUMABLE RECHARGING BOX

[75] Inventor: Michael D. LaBate, II, East Palestine, Ohio

[73] Assignee: Insul Company, Inc., East Palestine, Ohio

[21] Appl. No.: 905,604

[22] Filed: Aug. 4, 1997

[51] Int. Cl.[6] ..... C21B 7/14

[52] U.S. Cl. ..... 266/196; 266/216; 266/275

[58] Field of Search ..... 266/196, 275, 266/216; 249/197

[56] References Cited

U.S. PATENT DOCUMENTS

| | | | |
|---|---|---|---|
| 152,329 | 6/1874 | Carsley | 249/197 |
| 2,736,043 | 2/1956 | Temple | 249/197 |
| 2,915,386 | 12/1959 | Strauss | 266/216 |
| 3,158,911 | 12/1964 | Thompson | 249/197 |
| 3,165,798 | 1/1965 | LaBate | 249/197 |
| 3,212,749 | 10/1965 | LaBate | 249/197 |
| 3,827,680 | 8/1974 | Wheeler | 266/216 |
| 3,924,775 | 12/1975 | LaBate | 266/216 |
| 3,934,862 | 1/1976 | LaBate | 266/216 |
| 4,121,805 | 10/1978 | LaBate | 249/197 |
| 4,186,908 | 2/1980 | LaBate et al. | 249/197 |
| 4,262,885 | 4/1981 | LaBate | 266/196 |
| 4,350,325 | 9/1982 | LaBate | 266/196 |
| 5,284,328 | 2/1994 | LaBate, II | 266/196 |

*Primary Examiner*—Scott Kastler
*Attorney, Agent, or Firm*—Harpman & Harpman

[57] ABSTRACT

Consumable recharging containers for re-introducing cooled molten metal having impurities into a furnace or vessel or producing molten metal. The containers are formed of consumable materials of compatible chemistry with the remelting of molten metal and can be used in single, multiple and central pour configurations.

26 Claims, 5 Drawing Sheets

CONSUMABLE RECHARGING BOX

BACKGROUND OF THE INVENTION

1. Technical Field

This invention relates to consumable charging containers used to charge cooled metals with impurities into furnaces or other vessels.

2. Description of Prior Art

Prior art devices known are applicant's own U.S. Pat. No. 5,284,328 which discloses the basic consumable charge box of a specific consumable material formulation with modified bases having stacking abilities and a central multiple pour box filling arrangement.

Other prior art patents in the field including U.S. Pat. No. 152,329 which is directed to wooden boxes forming molds embedded in sand, clay or earth materials.

U.S. Pat. No. 2,736,043 discloses a consumable fiber liner for an ingot mold.

U.S. Pat. No. 3,158,911 is directed to tubs formed of inorganic fibrous materials in ingot molds.

Other prior art patents are directed towards consumable hot tops for ingot molds and blast furnace runners, see for example U.S. Pat. No. 3,165,798 (LaBate), 3,212,749 (LaBate), 4,121,805 (LaBate), 4,186,908 (LaBate), 4,262,885 (LaBate), and 4,350,325 (LaBate).

The present invention discloses a major improvement over prior art wherein consumable charge boxes for recharging materials into a furnace or a vessel for the production of molten metal is disclosed wherein the charge boxes in the form of consumable containers are of a shape and size that enables the container with solidified molten metal within can be picked up and recharged into the furnace for rapid remelting due to the combination of residual heat within the container before total solidification and the insulation of the container itself. Additionally, the interdependence of containers is disclosed wherein multiple containers can be combined together into a single container in which the contents of each container communicates with the adjacent containers.

SUMMARY OF THE INVENTION

An expendable consumable charge box having a variety of different configurations to delineate an individual box having lifting engagement enhancements and interior divisions as well as modular units of uniform size and shape that can be combined together to form a single intercommunicating multiple chambered box. The consumable charge boxes are formed of consumable materials of formulations including alumina, magnesium oxide, and limestone or dolomite with binders, materials that may be reduced in size by direct contact with molten metal to provide a safe and ecological method of handling of recyclable solidified metals for any type of furnace or vessel used in the production of molten metal wherein the chemistry of the consumable containers is ideal and is of a compatible chemistry to the remelting of the molten metal.

DESCRIPTION OF THE PREFERRED EMBODIMENT

Figure 1:
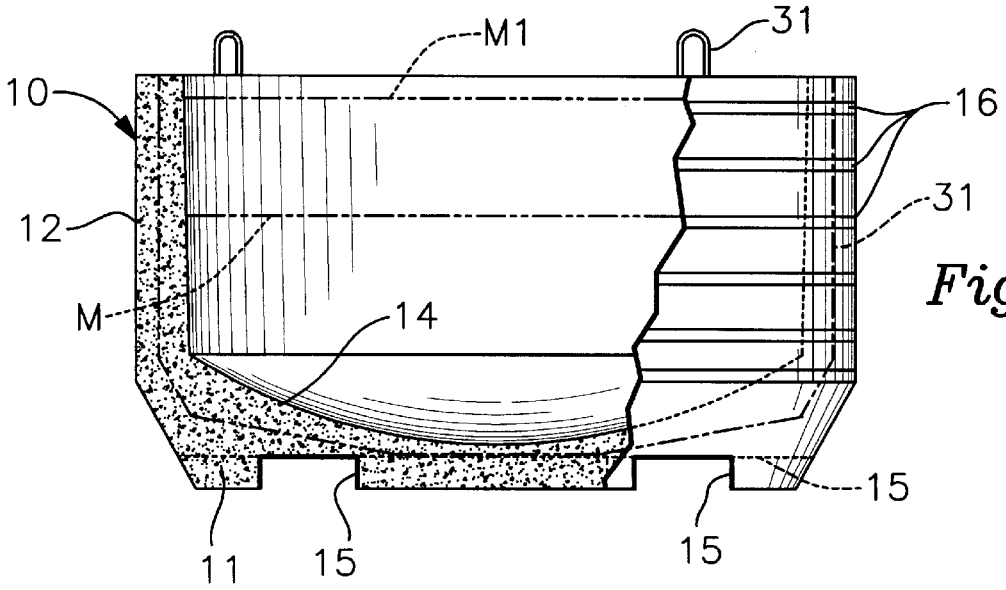
FIG. 1 is a side elevational view with parts in cross-section of a consumable charge box of the invention.
Figure 2:
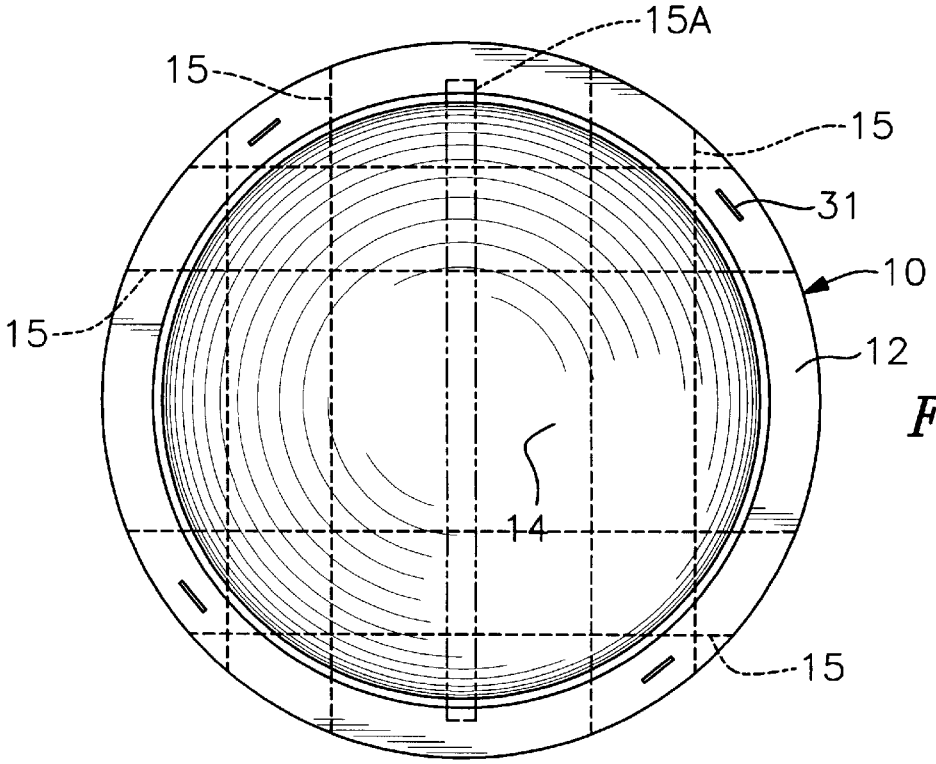
FIG. 2 is a top plan view thereof.

Referring to FIGS. 1 and 2 of the drawings, a cross-sectional side elevation of one form of the consumable charge box of the present invention may be seen and referring thereto it will be seen that it comprises a main body 10 having a bottom 11, a continuous sidewall 12 defining an open top at 13.

The bottom 11 is thicker than the sidewalls and is preferably formed with a concave cavity 14 defining its innermost lower surface.

The bottom 11 additionally has multiple-crossed pairs of oppositely disposed parallel engagement recesses 15 thereacross for registration with a forklift (not shown) for pick-up and transporting as will be described in greater detail hereinafter.

A plurality of metal bands 16 extend around the main body member 10 in spaced horizontal relation to one another to provide reinforcement to the charge box as it is filled with molten steel (not shown).

Referring to FIG. 2 of the drawings, a divider 15A is shown in broken lines that may be used in an alternate form of the invention to define two compartments within the hereinbefore described charge box. It will be evident to those skilled in the art that the final pouring of metal from furnaces or other vessels usually has impurities therein and heretofore has simply been poured on a floor and allowed to solidify and then cut up with a torch into pieces which are picked up and individually recharged into the furnace. The charging box of the invention is used to contain this final pour so that it can be recharged as cooled modular units into the furnace.

In the present invention, the materials of the main body of the charging box 10 and alternate forms set forth in FIGS. 3–7 of the drawings are of a chemistry that is ideal and compatible with the chemistry of the remelting of molten metal.

Figure 5:
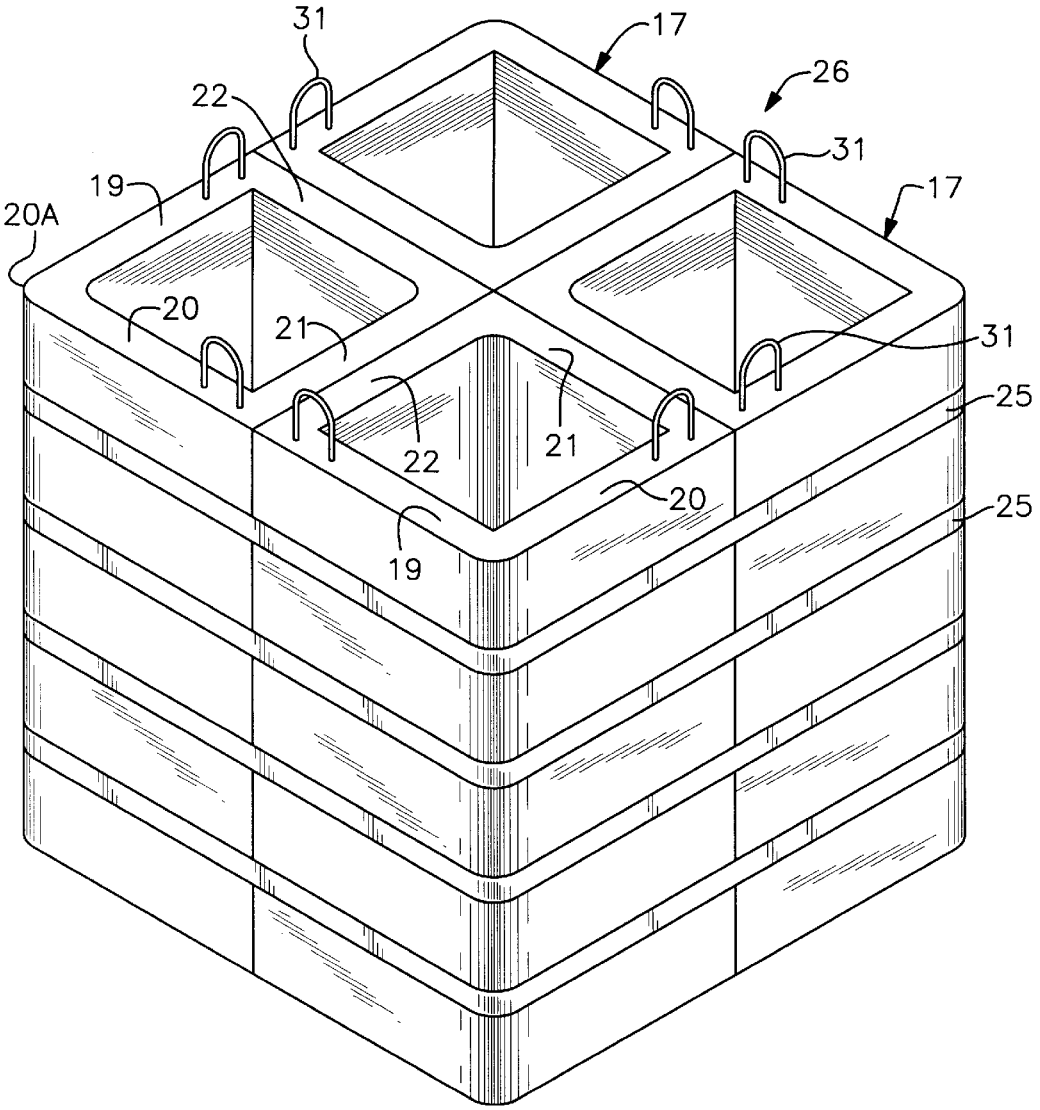
FIG. 5 is a perspective view of a multiple unit charge box formed from modular consumable boxes of FIG. 7.
Figure 6:
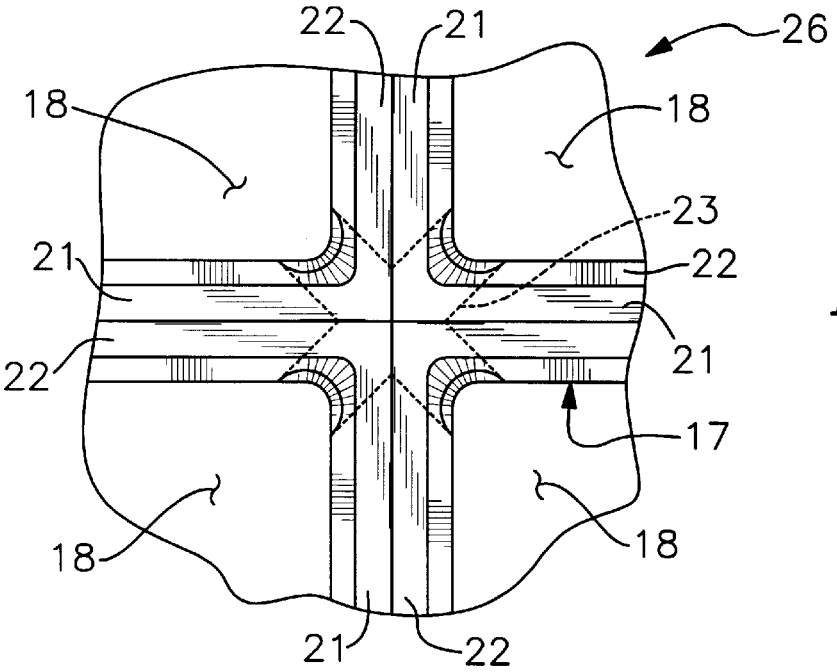
FIG. 6 is an enlarged detail based on a top plan view of the multiple unit charge box.
Figure 7:
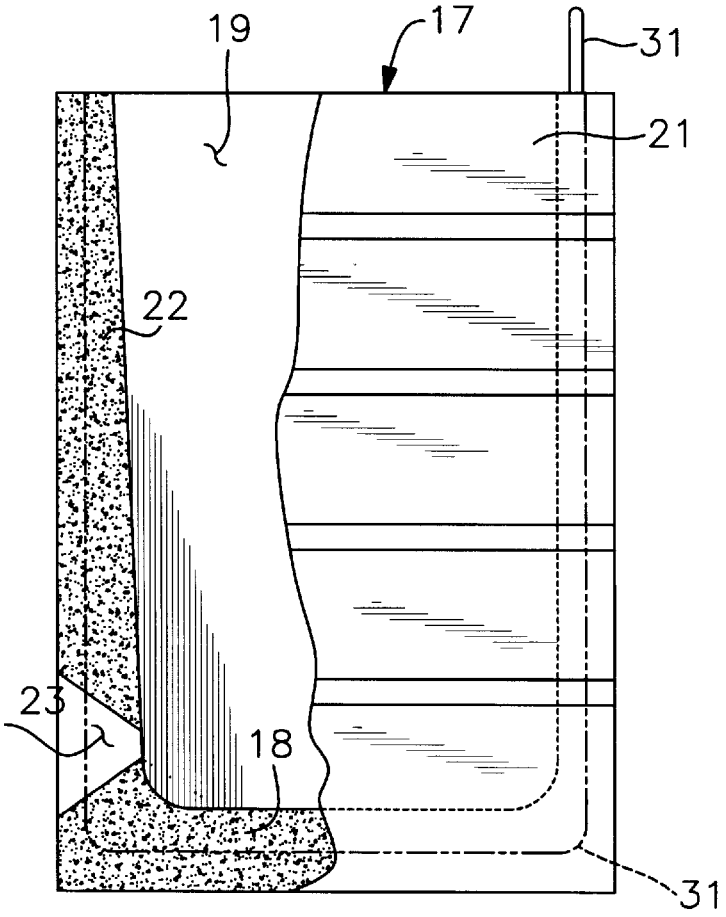
FIG. 7 is a side elevational view of a modular consumable box with parts in cross-section.

Referring now to FIGS. 5, 6 and 7 of the drawings, alternate charge boxes 17 can be seen wherein each of the boxes 17 have a bottom 18, multiple sidewalls 19, 20, 21, and 22 and a top opening at 23. The bottom 18 is thicker than the respective sidewalls which are straight on their outer surface and taper inwardly on their inner surfaces from the top opening at 23 to the bottom 18. The junction of the respective sidewalls 19 and 20 is curved on the outer surface at 20A so that multiple boxes 17 can be arranged together as illustrated in FIG. 6 of the drawings to form a single container.

Figure 3:
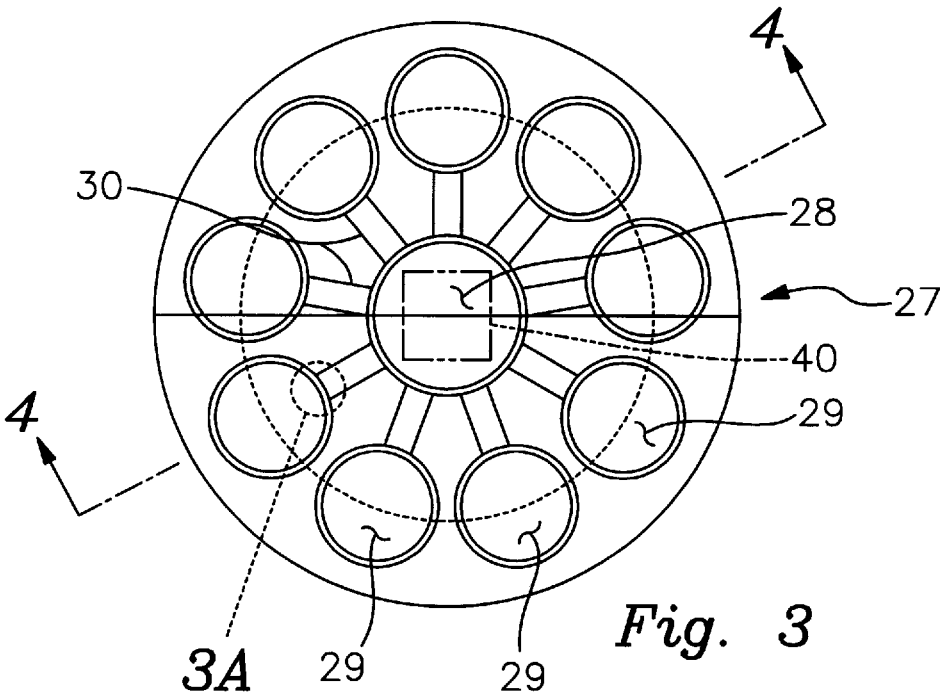
FIG. 3 is a top plan view of the box shown in FIG. 4.
Figure 3A:
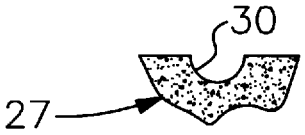
FIG. 3A is an enlarged detail of a portion of FIG. 3.
Figure 4:
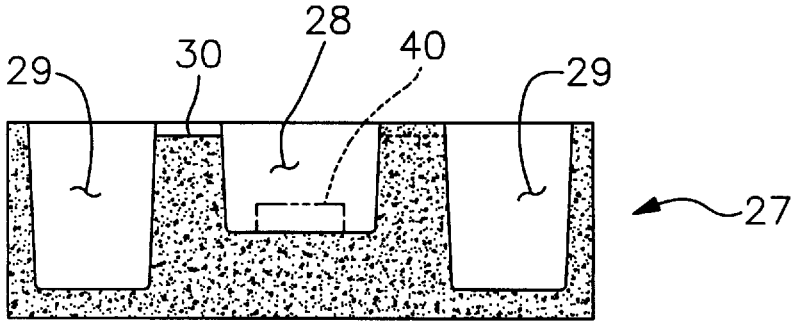
FIG. 4 is a cross-sectional view of a central pour multiple container consumable charge box.

Each of the recharging boxes 17 have a tapered opening at 24 adjacent the bottom 18 between the junction of the respective sidewalls 21 and 22 as best seen in FIGS. 5 and 7 of the drawings. The openings 24 in the respective charge boxes 17 interengage with one another when a set of four of said boxes are grouped together as shown. This arrangement allows for cross-box filling of molten metal when in use. Alternate metal support bands 25 are positioned about the grouped box set in parallel spaced vertical relation to one another securing the boxes 17 together to form a main charge box unit 26. Referring to FIGS. 3, 3A and 4 of the drawings, a monolithic multiple chambered charge box 27 can be seen wherein a central pouring distribution chamber 28 is in communication with a plurality of satellite chambers 29 by independent shallow pouring channels 30 that divert poured molten metal into the respective satellite chambers 27 once the central pouring chamber 28 is filled as will be well understood by those skilled in the art.

Each of the charge boxes hereinbefore described has a reinforcing mesh 31 shown in broken lines embedded within the walls and bottoms for reinforcing of same and have lifting loops 32 extending from the respective sidewalls as will be well known to those skilled in the art.

The consumable materials of the charge boxes of the invention are so formed as to withstand a large displacement force generated by the weight of the molten metal poured therein, additionally, in some applications an impact pad 40 can be used as illustrated in FIG. 3 of the drawings formed of known refractory materials typical within the art. The consumable mix from which the recharge boxes are formed can be made of the following materials; limestone, dolomite, sodium silicate, silica flour and sand of material type that will be reduced in size by direct contact with temperatures of molten metal.

Binders necessary in the consumable mix can be any one of a series that can be used in similar consumable products set forth in related prior art U.S. patents such as in this example sodium silicate and silica flour.

A typical mix can be comprised of the following; limestone, sand, sodium silicate, and silica flour. The percentage of the various materials vary due to the size and shape of the rechargeable containers and are comparable generally with materials and ranges used in consumable constructions hereinbefore referred to.

For example, a typical formulation for the improved form of the invention is referred to as a Limestone A mix is as follows; limestone, in an about 65–71% by weight, sand in an amount between 18–24% by weight, sodium silicate 4–10% by weight and silica flour 2–8% by weight with amounts of several ingredients being sufficient to provide necessary strength to the consumable charge boxes.

A further example of a typical and satisfactory analysis of materials capable of being used in the present invention can be those set forth in a formulation referred to as Limestone B mix is as follows; limestone 69–75% by weight, limestone 18–24% by weight and sodium silicate 4–10% by weight.

A further example of formulations are referred to as Limestone C comprises the following; regular sand 41–47% by weight, fine sand 40–46% by weight, sodium silicate 6–12% by weight and silica flour 1–7% by weight.

It will be noted that dolomite can be substituted for limestone in total in either "A" or "B" mixes.

Alternate formulations based on either alumina or magnesium oxide can be used in special applications.

An example of a typical alumina formulation is as follows;

Alumina (−30 mesh) 12–17%; alumina (−16 mesh) 22–30%; alumina (10×30 mesh) 14–20%; unground alumina 2–4%; alumina silicate (8×20 mesh) 10–16%; and sodium silicate and water at 16–24% by weight.

The alumina used can be of varying degrees of purity in the range of 45% such as fire clay to 99+%, such as tabular alumina depending on the quality use requirements and temperature resistance needed. An example of a typical magnesium oxide formulation is as follows: magnesium oxide (12 mesh) 62–70%; magnesium oxide (60 mesh) 7–12%; ball mill ceramic fiber 7–12%; sodium silicate 8–13% and boric acid 1–4% by weight.

Applicant's prior U.S. Pat. No. 5,284,328 is directed to a pre-fabricated consumable charge box into which molten metal from a blast furnace at the end of a pour is contained for recharging purposes. The devices set forth in the 5,284,328 patent are formed from a consumable material containing 61% by weight limestone, 22% by weight sodium silicate and 17% by weight sawdust.

An alternate additive can be used in the above referred to formulations for increased strength by inclusion of metal fibers 41 commercially available as steel fibers. The metal fibers 41 create an interlocking network within the consumable material that helps bind the charge box into a homogenous unitary mass, eliminating the need for surface support bands 16 and/or internal reinforcement in the single box use configurations.

From the foregoing, it will be seen that the improved consumable recharging boxes set forth in the present invention provides improved features over applicant's own earlier U.S. Pat. No. 5,284,328 by including, for example, the divisional divider 15A, lifting engagement recesses 15 and the main charge box 26 which is comprised from multiple units 17 attached to one another to form an inner communicating multiple chamber configuration within.

It will also be observed that the formation of the consumable charge boxes and their ability to be assembled enables them to be conventionally packaged and shipped to the customer by usual refractory transportation means.

Practical experience with the invention by Insul Company, Inc. with several plants in the U.S. serving the steel industry and others have proven the cost savings and time savings advantages of the improved invention due primarily to the versatility of the invention and its ability to be adapted to various quantities of end poured molten metals and holding the same for solidification and then providing a convenient and quick way of recharging both consumable charge box and their contents into the furnace thereby avoiding the hereinbefore costly and time consuming practice of pouring end volumes of molten metal on the floor and waiting for solidification of same and then cutting up solidified end poured metals with torches to enable it to be recharged into a furnace.

Figure 8:
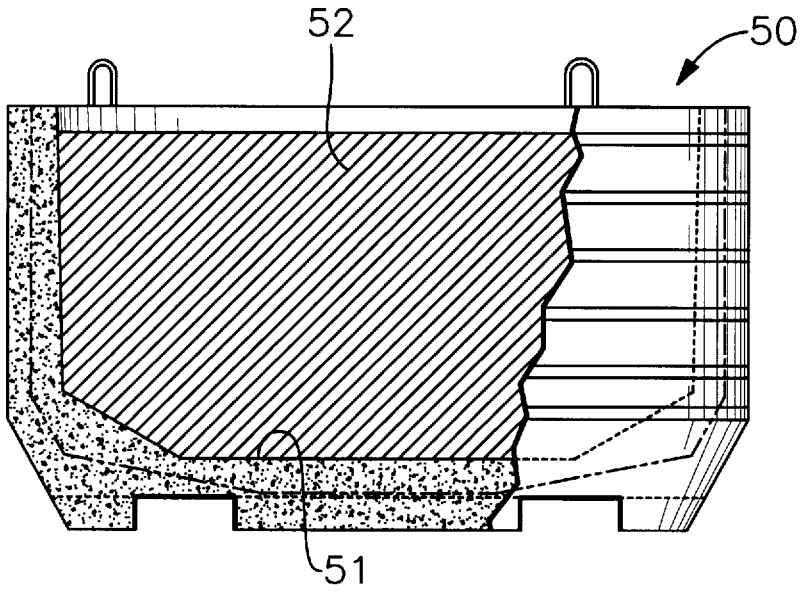
FIG. 8 is a side elevational view of an alternate charge box with parts in cross-section.

Alternate use configurations are possible by use of the consumable rechargeable boxes 10 as illustrated in FIGS. 1, 5 and 8 of the drawings.

Initially a partial filling of the consumable recharge box 10 with molten metal M from a pour as seen in FIG. 1 in broken lines at M, then transporting same to a storage location, not shown, until needed at a later time when a similar metal pour is taking place filling to M1. This ability to partially fill and delay usage greatly increases the efficiency and cost savings of partial fill use hereinbefore incurred.

Figure 9:
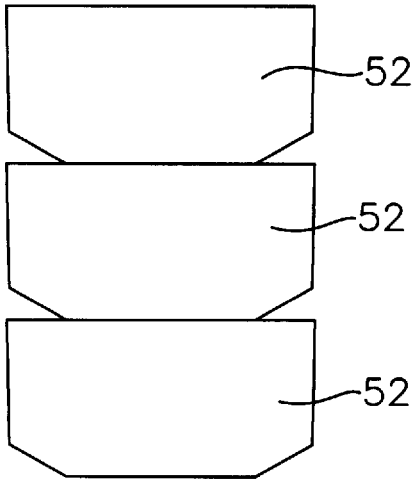
FIG. 9 is a side elevational view of stackable ingots from consumable boxes illustrated in FIG. 8.

FIG. 8 illustrates a modified consumable recharge box 50 having a flat interior bottom surface at 51. This allows some users to remove a cooled partial pour ingot 52 and stack it for future use as seen in FIG. 9 of the drawings.

Although, but three embodiments of the present improvement of the invention have been illustrated and described it will be apparent to those skilled in the art that various changes and modifications may be made therein without departing from the spirit of the invention or the scope of the claims and having thus described my invention.

What I claim is:

1. A charge box for receiving, holding and recharging material from a molten metal furnace into said molten metal furnace comprising; a container having a bottom and upstanding sidewalls extending therefrom, said sidewalls and bottom being of known thickness, said charge box is of a solid monolithic shape of consumable materials of known density having a pre-determined lifetime when in contact with molten metal from a furnace, a pair of spaced paralleling elongated recesses in said bottom surface for moving said container, said bottom defining a reduced outside base area, said outside area defined by said sidewalls.

2. The charge box set forth in claim 1 wherein said consumable material consist essentially of about 65–71% by weight of limestone, 18–24% by weight of regular sand, 4–10% by weight sodium silicate and 2–8% by weight silica flour.

3. The charge box set forth in claim 1 wherein said consumable materials consist of 69–75% by weight limestone, 18–24% by weight limestone, and 4–10% sodium silicate.

4. The charge box set forth in claim 1 wherein said consumable material consist of 40–46% by weight sand, 41–47% by weight sand, 6–12% by weight sodium silica, and 1–7% by weight silica flour.

5. The charge box as set forth in claim 1 wherein said consumable material consist essentially of about 22–30% by weight of alumina (−16 mesh); 14–20% by weight alumina (10×30 mesh); 12–17% by weight alumina (−30 mesh); 10–16% by weight alumina (8×20) mesh; and 2–4% by weight of unground alumina.

6. The charge box as set forth in claim 5 wherein said alumina is selected from a group having a purity of between 45%–99% alumina.

7. The charge box set forth in claim 1 wherein said consumable materials consist essentially of about 62–70% by weight of magnesium oxide (16 mesh); 8–13% by weight sodium silicate; 7–12% by weight ball mill ceramic fiber and 1–4% by weight of boric acid.

8. A charge box set forth in claim 1 wherein metal fibers can be added to said consumable materials for increased strength to said charge box.

9. The charge box set forth in claim 1 wherein said upstanding sidewalls are cylindrical.

10. A charge box for receiving and recharging molten metal from a molten metal furnace into said molten metal furnace comprises; a plurality of containers having a bottom and upstanding sidewalls extending therefrom, said sidewalls being of a known thickness and said bottom is of a thickness greater than that of said sidewalls, said charge boxes are of a monolithic shape of consumable materials of a known density having a predetermined lifetime determined by said density, an aperture in said sidewalls of each of said containers for direct communication with each of said other apertures of said adjacent containers in a multiple arranged group, means for securing said containers to one another in said group.

11. The charge box set forth in claim 10 wherein said means for securing said containers to one another in said group comprises; a plurality of support bands extending about said group container.

12. The charge box set forth in claim 11 wherein said support bands are in parallel spaced vertical relation to one another.

13. The charge box set forth in claim 10 wherein said upstanding sidewalls are parallel for selected engagement with adjacent containers within said group.

14. The charge box set forth in claim 10 wherein said consumable material consist essentially of about 65–71% by weight limestone, 18–24% by weight sand, 4–10% by weight sodium silicate and 2–8% by weight silica flour.

15. The charge box set forth in claim 10 wherein said consumable materials consist of 69–75% by weight limestone, 18–24% by weight limestone, and 4–10% sodium silicate.

16. The charge box set forth in claim 10 wherein said consumable material consist of 40–46% by weight sand, 41–47% by weight sand, 6–12% by weight sodium silica, and 1–7% by weight silica flour.

17. A charge box for receiving and recharging molten metal from a molten metal furnace into said molten metal furnace comprises; a monolithic multiple chambered charge box, a central distribution chamber, a plurality of satellite chambers, integral pouring chambers between said central chamber and said satellite chambers, said charge box of consumable materials of a known density having a predetermined lifetime determined by said density and combustibility of said consumable material.

18. The charge box set forth in claim 17 wherein said consumable material consist essentially of about 65–71% by weight limestone, 18–24% by weight sand, 4–10% by weight sodium silicate and 2–8% by weight silica flour.

19. The charge box set forth in claim 17 wherein said consumable materials consist of 69–75% by weight limestone, 18–24% by weight limestone, and 4–10% sodium silicate.

20. The charge box set forth in claim 17 wherein said consumable material consist of 40–46% by weight sand, 41–47% by weight sand, 6–12% by weight sodium silica, and 1–7% by weight silica flour.

21. A charge box as in claims 18, 19, and 20 wherein metal fibers are added to said consumable material for increased strength to said charge box formulations.

22. A charge box for receiving, holding and recharging material from a molten metal furnace into said molten metal furnace comprising; a container having a bottom and upstanding sidewalls extending therefrom, said sidewalls and bottom being of a known thickness, said charge box of a solid monolithic shape of consumable materials of a known density having a predetermined lifetime when in contact with molten metal in a furnace, pairs of right angularly disposed elongated parallel recesses in said bottom surface for moving said container, a divider between said sidewalls and said bottom.

23. The charge box set forth in claim 22 wherein said consumable materials consist of 69–75% by weight limestone, 18–24% by weight limestone, and 4–10% sodium silicate.

24. The charge box set forth in claim 22 wherein said consumable material consist of 40–46% by weight sand, 41–47% by weight sand, 6–12% by weight sodium silica, and 1–7% by weight silica flour.

25. The charge box as set forth in claim 22 wherein said consumable material consist essentially of about 22–30% by weight of alumina (−16 mesh); 14–20% by weight alumina (10×30 mesh); 12–17% by weight alumina (−30 mesh); 10–16% by weight alumina (8×20) mesh; and 2–4% by weight of unground alumina.

26. The charge box set forth in claim 22 wherein said divider is comprised of limestone.

* * * * *